US009290319B2

(12) United States Patent
Han

(10) Patent No.: US 9,290,319 B2
(45) Date of Patent: Mar. 22, 2016

(54) CONCEAL TRASH CAN LID COVER

(71) Applicant: BARENTHAL NORTH AMERICA, INC., Whippany, NJ (US)

(72) Inventor: Hongyuan Han, New Vernon, NJ (US)

(73) Assignee: BARENTHAL NORTH AMERICA, INC., Whippany, NJ (US)

( * ) Notice: Subject to any disclaimer, the term of this patent is extended or adjusted under 35 U.S.C. 154(b) by 43 days.

(21) Appl. No.: 14/018,805

(22) Filed: Sep. 5, 2013

(65) Prior Publication Data

US 2014/0305946 A1 Oct. 16, 2014

Related U.S. Application Data

(60) Provisional application No. 61/853,905, filed on Apr. 15, 2013.

(51) Int. Cl.
*B65F 1/16* (2006.01)
*B65F 1/06* (2006.01)
*B65F 1/14* (2006.01)

(52) U.S. Cl.
CPC ... *B65F 1/06* (2013.01); *B65F 1/16* (2013.01); *B65F 1/163* (2013.01); *B65F 1/1623* (2013.01); *B65F 1/1638* (2013.01)

(58) Field of Classification Search
CPC ..... B65F 1/163; B65F 1/1638
USPC ..... 220/908.1
See application file for complete search history.

(56) References Cited

U.S. PATENT DOCUMENTS

| | | | | |
|---|---|---|---|---|
| 4,996,467 | A * | 2/1991 | Day | B65F 1/1638 318/283 |
| 6,010,024 | A | 1/2000 | Wang | |
| 6,739,565 | B1 | 5/2004 | Spadafora | |
| 7,225,943 | B2 * | 6/2007 | Yang | A61L 9/014 220/23.9 |
| 8,061,554 | B2 * | 11/2011 | Shikano | 220/826 |
| 2007/0266637 | A1 * | 11/2007 | McGowan | 49/349 |
| 2010/0193518 | A1 * | 8/2010 | Tontarelli | B65F 1/08 220/263 |
| 2014/0246432 | A1 * | 9/2014 | Yang | B65D 43/262 220/262 |

* cited by examiner

*Primary Examiner* — Hung V Ngo
(74) *Attorney, Agent, or Firm* — Preti Flaherty Beliveau & Pachios LLP

(57) ABSTRACT

The purpose of the invention is to provide an improved lid for covering a trash can or other waste receptacle with a removable interior liner. The lid includes a collar which fits concentrically around at least a portion of an exterior surface of a body of the waste receptacle. The collar extends the length or diameter and depth of the lid such that when positioned over the opening of the trash can, the lid conceals at least a portion of the exterior surface of the body of the waste receptacle and at least a portion of the removable interior liner from exterior view. The invention may or may not use ribs within the interior frame of the lid to allow proper positioning of the lid over the opening of the trash can body.

9 Claims, 8 Drawing Sheets

CONCEAL TRASH CAN LID COVER

STATEMENT REGARDING FEDERALLY SPONSORED RESEARCH OR DEVELOPMENT

Not applicable.

BACKGROUND OF THE INVENTION

This invention relates primarily to trash and waste handling and disposal.

Trash cans with a variety of lids such as, for example, manually opening, flip top or pop up lids are commonly used in the kitchen, bathroom and other household and commercial locations. Typically these lids are opened manually, by use of a mechanical pedal, or by activating a manual button or an infrared sensor, the latter which electromechanically opens the trash can lid. Most trash cans are used with an interior liner such as, for example, bag made of plastic or other material. Alternatively, a removable device such as, for example, a bucket or basket, can serve as the interior liner. The interior liner is placed directly inside the trash can and optionally, can be secured within a ring that fits concentrically inside the interior upper rim of the trash can. Typically, once the interior liner is inserted into the trash can, the upper part of the interior liner which may or may not be folded over the upper rim of the trash is visible on the exterior outside of the trash can even when a lid is used to cover the trash can opening. This visibility of the interior liner on the exterior of the trash can be considered untidy and/or unsightly.

SUMMARY

A purpose of this invention is to provide a lid for a trash can or other receptacle including an interior liner wherein the lid includes an extended collar for concealing at least a portion of the upper portion of the trash can and any interior liner which may be otherwise visible. The lid of the invention extends beyond the upper rim of the trash can and simultaneously clears any interior liner including any overhang of the liner.

In one aspect, the invention provides an article for covering an opening of a receptacle. The article includes a lid extending in a first direction. The lid includes a collar attached to at least a portion of the lid and extending in a second direction different from the first direction such that the collar can conceal at least a portion of an exterior surface of a body of the receptacle when the lid is placed over at least a portion of the opening of the receptacle. In one embodiment of this aspect of the invention, an area of the lid extends beyond an area of the opening of the receptacle and at least a portion of an area of an interior liner of the receptacle when the lid is centered to cover the opening of the receptacle. In another embodiment of this aspect, at least a portion of the lid is joined to a portion of the body of the receptacle. In yet another embodiment of this aspect, the lid is situated adjustably to cover the opening of the receptacle unless the lid is raised to permit access to the interior of the receptacle. In a further embodiment of this aspect, the receptacle includes a mechanical device or an electromechanical device for raising the lid above the opening of the receptacle to permit access to the interior of the receptacle. Optionally, the electrochemical device includes an infrared sensor. In another embodiment of this aspect of the invention, the lid further includes at least one rib on an interior frame of the lid for proper positioning of the lid on a body of the receptacle.

In another aspect, the invention provides an article for containment including a receptacle including an opening, a closed end and a body joining a perimeter of the opening with a perimeter of the closed end. The article further includes a lid joining at least a portion of a body of the receptacle for covering at least a portion of the opening of the receptacle. The lid includes a first surface extending in a first direction and a collar attached to at least a portion of the first surface and extending in a second direction different from the first direction. The collar is capable of surrounding at least a portion of the body of the receptacle when the lid is centered on at least a portion of the opening of the receptacle such that the collar conceals at least a portion of an exterior surface of the body of the receptacle.

In one embodiment of this aspect of the invention, an area of the lid extends beyond an area of the opening of the receptacle and at least a portion of an area of an interior liner of the receptacle when the lid is centered to cover the opening of the receptacle. In another embodiment of this aspect, the lid is situated adjustably to cover the opening of the receptacle unless the lid is raised to permit access to the interior of the receptacle. In yet another embodiment of this aspect, the article for containment further includes a mechanical device or an electromechanical device for raising the lid from the opening of the receptacle to permit access to the interior of the receptacle. In a further embodiment of this aspect, the electrochemical device includes an infrared sensor. In yet a further embodiment of this aspect, the lid further includes at least one rib on an interior frame of the lid for proper positioning of the lid on the body of the receptacle.

In yet another aspect, the invention provides an article for covering an opening of a waste receptacle with a removable interior liner. The article consists of a lid including a collar which fits concentrically around at least a portion of an exterior surface of a body of the waste receptacle. The collar extends the length and depth of the lid to conceal from exterior view at least a portion of the exterior surface of the body of the waste receptacle and at least a portion of the removable interior liner when the lid is centered on the opening of the receptacle.

The following detailed description of the aspects and embodiments of the invention taken in conjunction with the appended claims and accompanying drawings, provides a more complete understanding of the nature and scope of the invention.

BRIEF DESCRIPTION OF THE SEVERAL VIEWS OF THE DRAWINGS

The invention will be better understood by reference to the accompany drawings wherein.

DETAILED DESCRIPTION OF THE INVENTION

The present invention provides a lid for a trash can or other waste receptacle which conceals from exterior view the sight of an interior liner. The lid and the trash can be formed of various materials including but not limited to stainless steel, plastics or other commonly used materials. The lid can be formed in various shapes including but not limited to square, rectangular, semi-round, round, oval or any other practical shapes known to those of ordinary skill in the art. The lid of the invention incorporates an extended collar which fits concentrically around a portion of the exterior surface of the body of the trash can when the lid is covered over the opening of the trash can. The collar extends the length and the depth of the lid to conceal at least a portion of the exterior surface of the body of the trash can thereby concealing at least a portion of any removable interior liner situated within and exceeding and/or overlapping an upper rim of the trash can.

Figure 1:
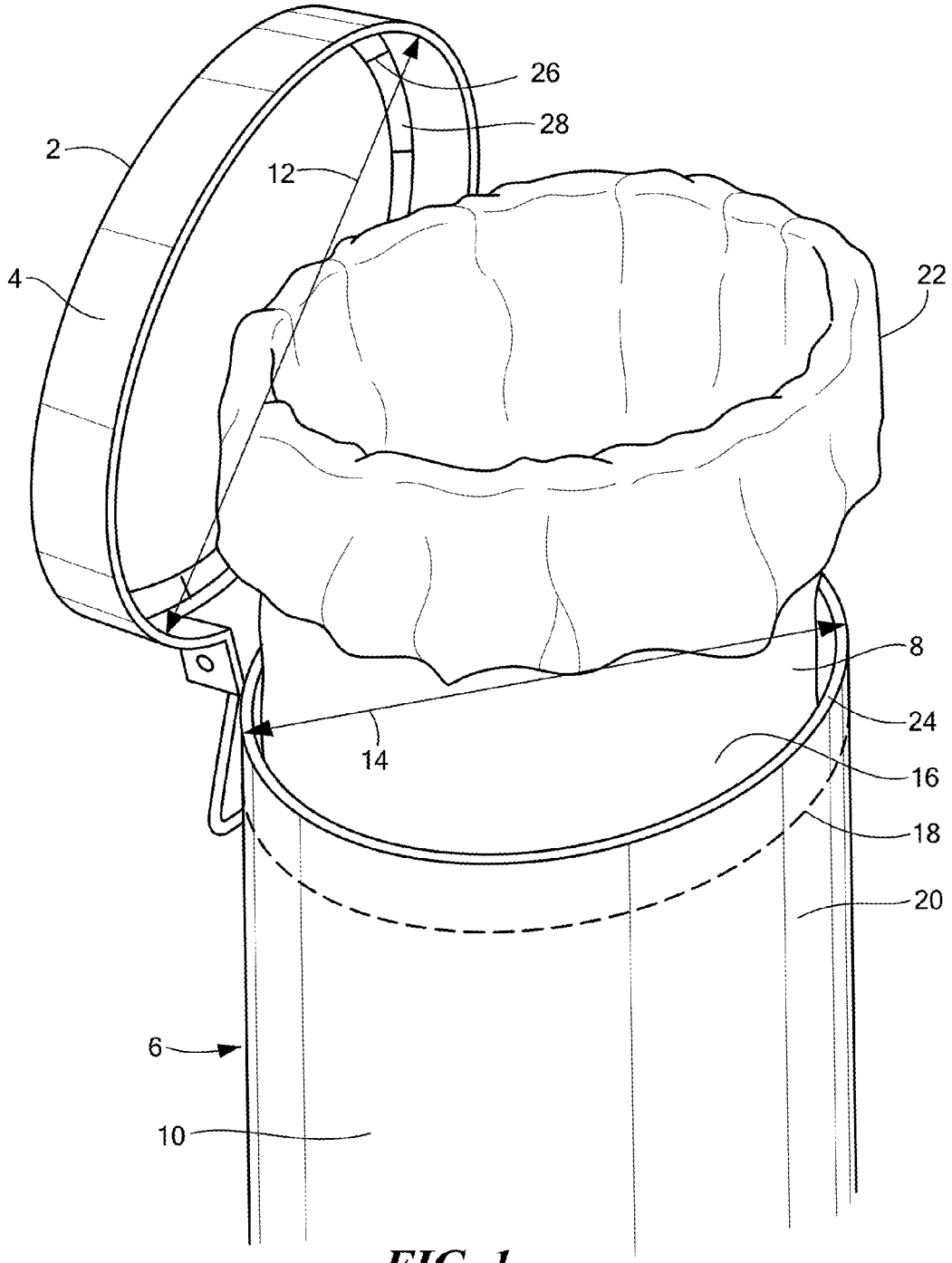
FIG. 1 is a view of the lid of the invention joined to a body of a trash can with an interior liner partially inserted inside the trash can body.

FIG. 1 illustrates the lid 2 of the invention. The lid 2 including a collar 4 is joined to a trash can 6 or other waste receptacle. A removable interior liner 8 is partially inserted into the interior of the body 10 of the trash can 6. The length or diameter 12 of the lid 2 including the collar 4 exceeds the outside diameter 14 of the body 10 of the trash can 6. Thus when the lid 2 is centered and closed over the opening 16 of the trash can 6, the lid 2 can conceal both a portion 18 (shown by broken lines) of the exterior surface 20 of the body 10 of the trash can 6 and any overhang 22 of the interior liner 6 of the trash can 4 which lies above and over the upper rim 24 of the body 10 of the trash can 6. The lid 2 of the invention may optionally use ribs 26 within the interior frame 28 of the lid 2 to allow proper positioning of the lid 2 over the opening 16 of the body 10 of the trash can 6.

Figure 2:
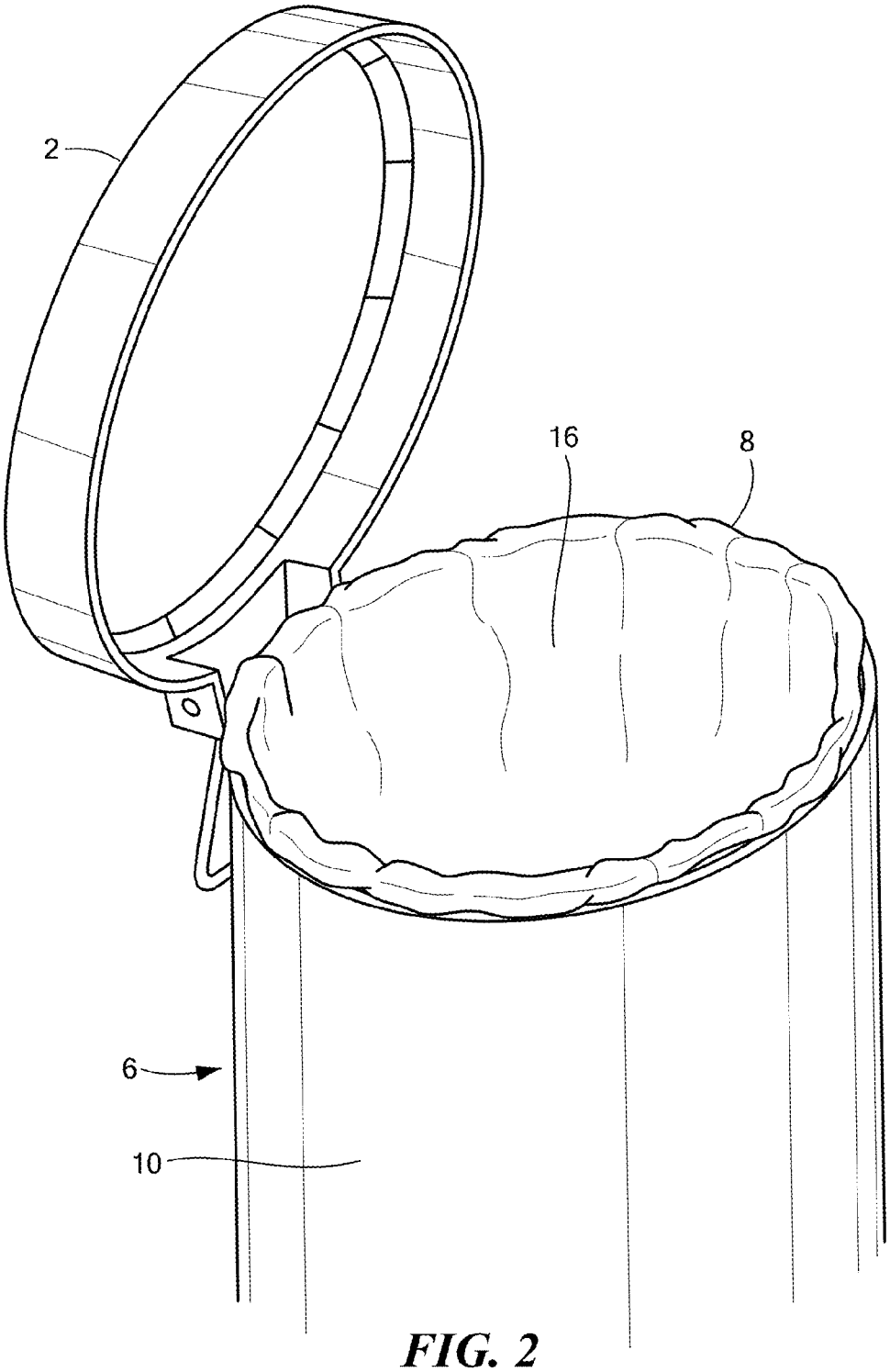
FIG. 2 is a ¾ view of the lid of the invention joined to and fully opened over a joined body of a trash can.

FIG. 2 provides a ¾ view of the lid 2 of the invention joined to and fully opened over the body 10 of trash can 6. FIG. 2 illustrates the removable interior liner 8 fully inserted into the opening 16 of the body 10 of the trash can 6. FIG. 2 demonstrates that when the lid 2 is open, the interior liner 8 is easily visible.

Figure 3:
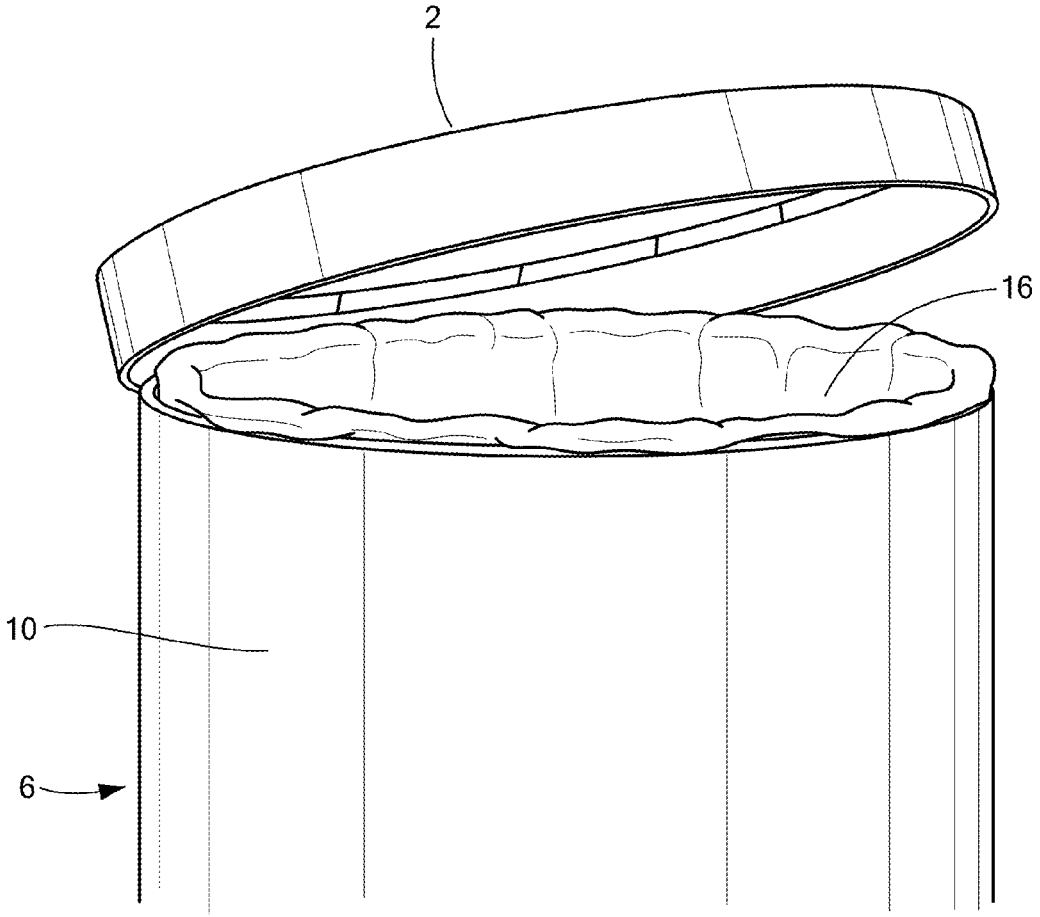
FIG. 3 is a ¾ view of the lid of the invention joined to and partially closed over a joined body of a trash can.

FIG. 3 provides a ¾ view of the lid 2 of the invention joined to and partially closed over an opening 16 of the body 10 of the trash can 6.

Figure 4:
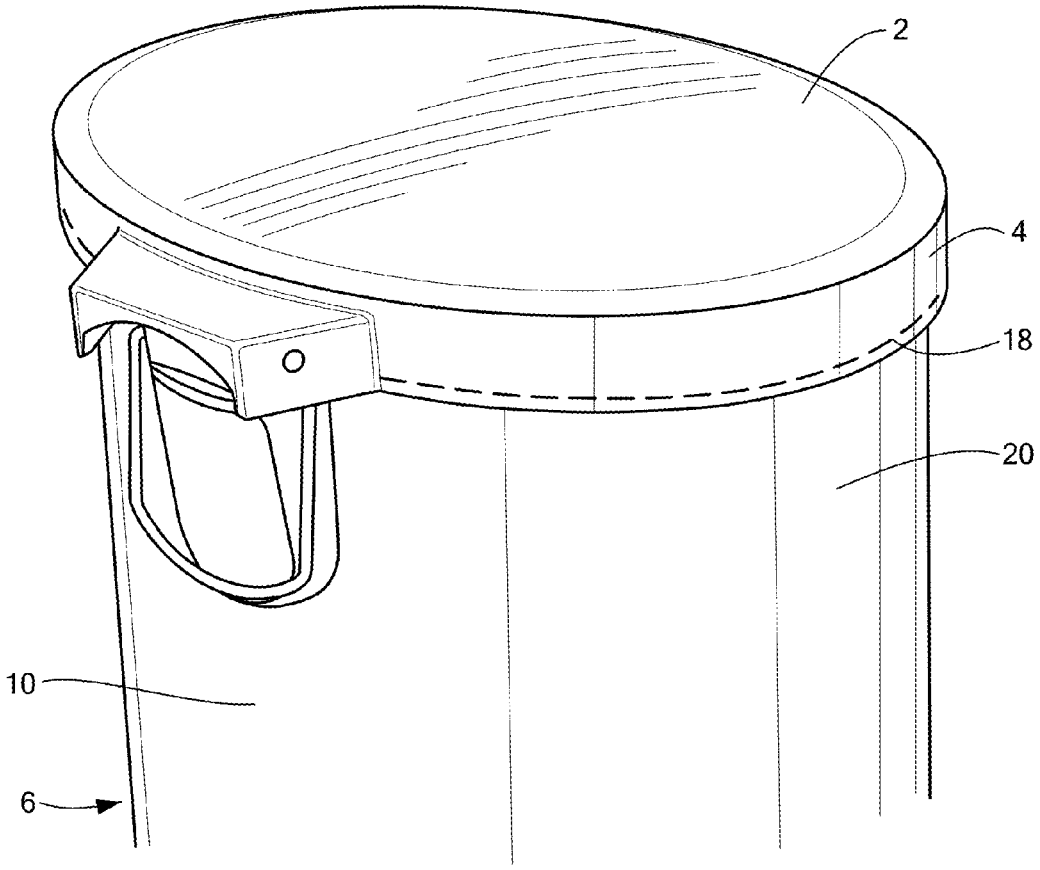
FIG. 4 is a view of the lid of the invention joined to and fully closed over a body of a trash can.

FIG. 4 provides a view of the lid 2 of the invention joined to and fully closed over a body 10 of a trash can 6. FIG. 4 illustrates the lid 2 concealing a portion 18 (identified by a broken line) of the exterior surface 20 of the body 10 of the trash can 6.

Figure 5:
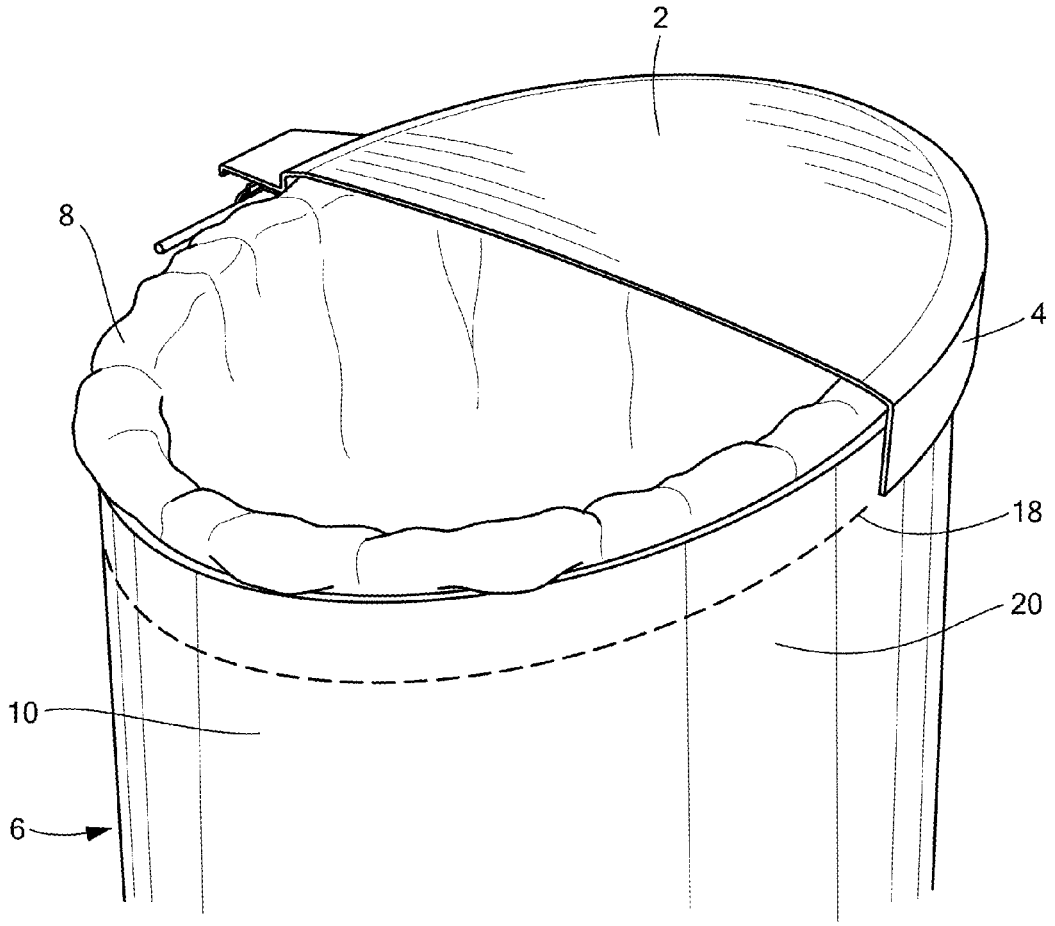
FIG. 5 provides a ¾ cut-away view of the lid of the invention joined to and fully closed over a body of a trash can.

FIG. 5 provides a ¾ cut-away view of the lid 2 of the invention joined to and fully closed over a body 10 of a trash can 6. The lid 2 including the collar 4 conceals the interior liner 8 and a portion 18 (shown by broken lines) of the exterior surface 20 of the body 10 of the trash can 6.

Figure 6:
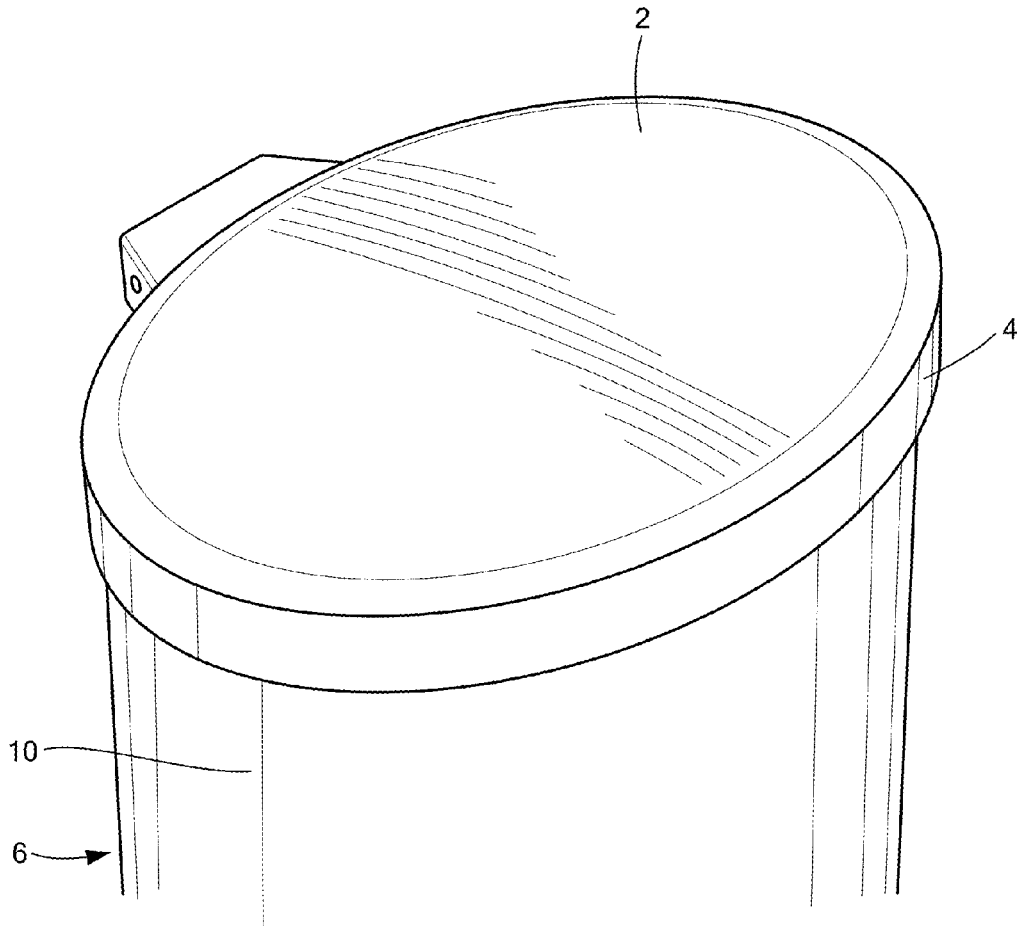
FIG. 6 provides a head-on view of the lid of the invention joined to and covering a body of a trash can.
Figure 7A:
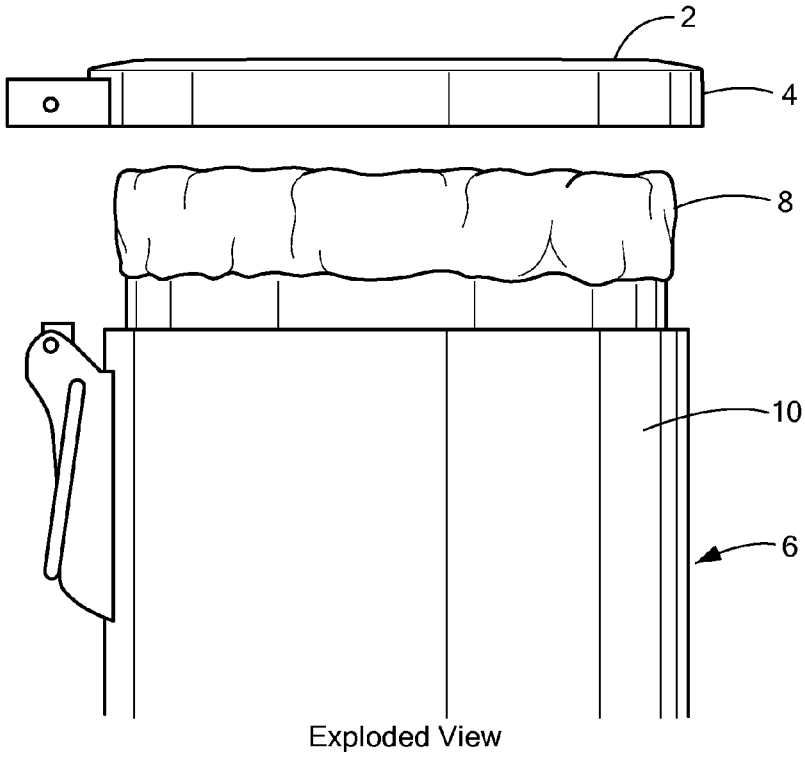
FIG. 7 (*a*)-(*d*) provide various side views of the lid of the invention.
Figure 7B:
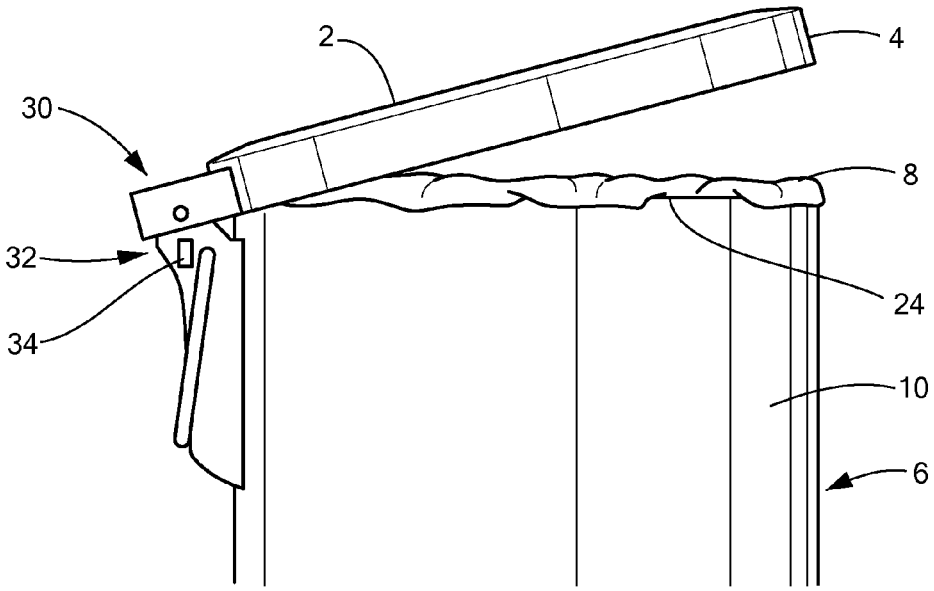
Figure 7C:
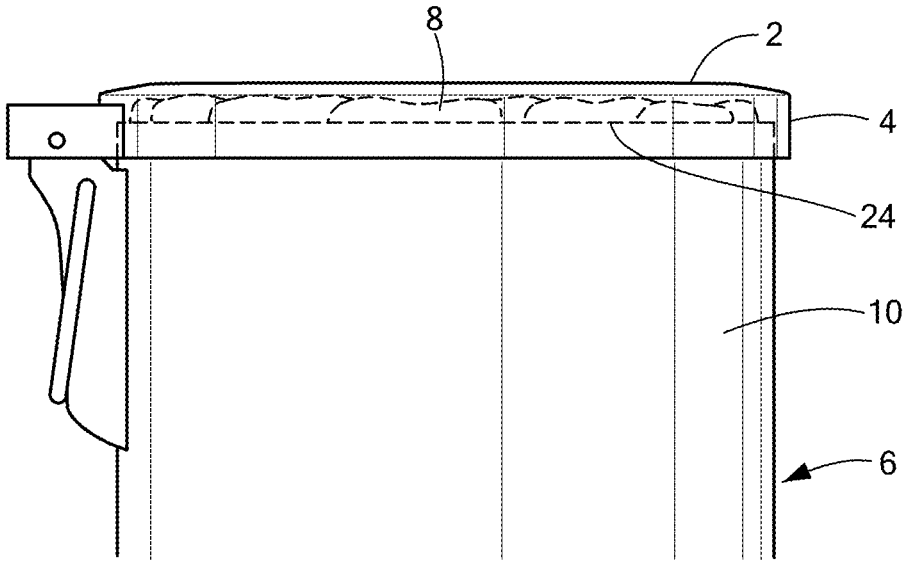
Figure 7D:
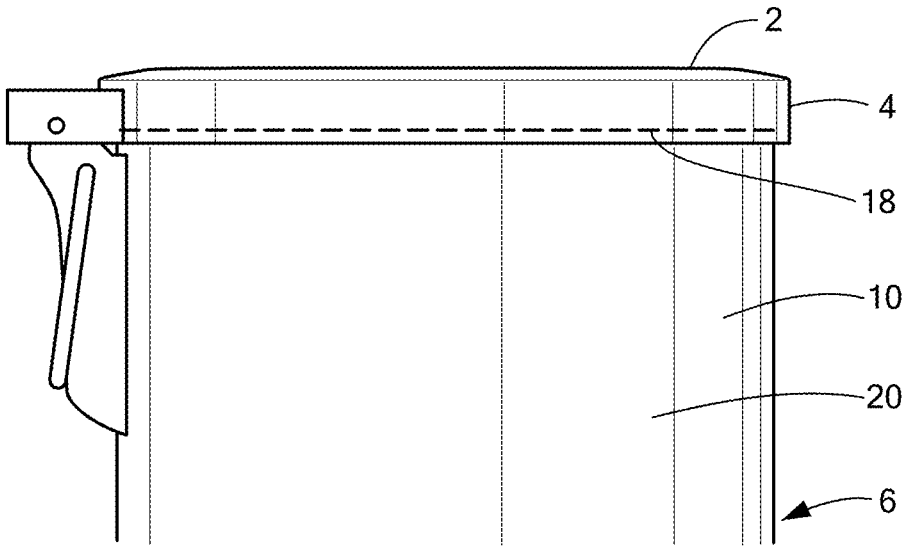

FIG. 6 provides a head-on view of the lid 2 including the extended collar 4 of the invention joined to and covering a body 10 of a trash can 6.

FIG. 7 (*a*)-(*d*) provide various side views of the lid of the invention. In FIG. 7*a*, an exploded side view shows the lid 2 including the collar 4 situated above the interior liner 8 positioned inside the body 10 of the trash can 6. FIG. 7*b* provides a side view of the lid 2 of the invention where the lid 2 including the collar 4 is half open over the trash can 6 and the interior liner 8 is visible above upper rim 24 of the body 10 of the trash can 6. FIG. 7*b* shows the receptacle including a mechanical device 30 or an electromechanical device 32 for raising the lid above the opening of the receptacle to permit access to the interior of the receptacle. Optionally, the electromechanical device 32 includes an infrared sensor 34. FIG. 7*c* provides a translucent side view of the lid 2 of the invention showing the interior liner 8 situated above the upper rim 24 of the body 10 of the trash can 6 being concealed by the collar 4 of the lid 2 of the invention. FIG. 7*d* provides a side view of the lid 2 of the invention showing the lid 2 closed over the trash can 6 such that the collar 4 conceals a portion 18 (identified with broken lines) of the exterior surface 20 of the body 10 of trash can 6.

The aspects and embodiments of the present invention described herein are merely illustrative and not restrictive. Accordingly, the present invention may be embodied in other specific forms without deviating from the spirit of the invention.

What is claimed is:

1. An article for covering an opening of a receptacle with a removable interior liner comprising:

a lid having a consistent form and extending in a first direction, the lid including a collar integral to the lid, projecting from at least a portion of the lid, extending in a second direction different from the first direction, and having a length in the second direction adapted to conceal at least a portion of an exterior surface of the receptacle and an upper part of the removable interior liner which may be otherwise visible above or on the exterior surface of the receptacle when the lid is placed over at least a portion of the opening of the receptacle;

wherein the article includes at least one of a mechanical device or an electromechanical device for raising the lid above the opening of the receptacle to permit access to an interior of the receptacle;

wherein the lid includes at least one rib on an interior frame of the lid for proper positioning of the lid on a body of the receptacle;

wherein the body of the receptacle joins a perimeter of the opening of the receptacle with a perimeter of a closed end of the receptacle, the body being continuous at the perimeter of the opening of the receptacle; and wherein a diameter of the lid including the collar exceeds an outside diameter of the body of the receptacle.

2. The article of claim 1, wherein an area of the lid extends beyond an area of the opening of the receptacle and at least a portion of an area of an interior liner of the receptacle when the lid is centered to cover the opening of the receptacle.

3. The article of claim 1 wherein at least a portion of the lid is joined to a portion of the body of the receptacle.

4. The article of claim 3, wherein the lid is situated adjustably to cover the opening of the receptacle unless the lid is raised to permit access to an interior of the receptacle.

5. The article of claim 1, wherein the electromechanical device comprises an infrared sensor.

6. An article for containment comprising:

a receptacle including an opening, a closed end, and a body joining a perimeter of the opening with a perimeter of the closed end;

a removable liner disposed at least partially within the receptacle;

a lid joining at least a portion of the body of the receptacle for covering at least a portion of the opening of the receptacle, the lid having a consistent form and extending in a first direction, the lid including a collar integral to the lid, projecting from at least a portion of the lid, extending in a second direction different from the first direction, the collar capable of surrounding at least a portion of the body of the receptacle and having a length in the second direction adapted to conceal at least a portion of an exterior surface of the receptacle and an upper part of the removable interior liner which may be otherwise visible above or on the exterior surface of the receptacle when the lid is centered on at least a portion of the opening of the receptacle;

wherein the article further comprises at least one of a mechanical device or an electromechanical device for raising the lid from the opening of the receptacle to permit access to an interior of the receptacle;

wherein the lid further comprises at least one rib on an interior frame of the lid for proper positioning of the lid on a body of the receptacle; and wherein the body of the receptacle joins a perimeter of the opening of the receptacle with a perimeter of a closed end of the receptacle, the body being continuous at the perimeter of the opening of the receptacle; and wherein a diameter of the lid including the collar exceeds an outside diameter of the body of the receptacle.

7. The article of claim 6, wherein an area of the lid extends beyond an area of the opening of the receptacle and at least a portion of an area of an interior liner of the receptacle when the lid is centered to cover the opening of the receptacle.

8. The article of claim 6, wherein the lid is situated adjustably to cover the opening of the receptacle unless the lid is raised to permit access to the interior of the receptacle.

9. The article of claim 6, wherein the electromechanical device comprises an infrared sensor.

* * * * *